US010945566B2

(12) United States Patent
Williams, Jr. et al.

(10) Patent No.: US 10,945,566 B2
(45) Date of Patent: Mar. 16, 2021

(54) PRODUCT IDENTIFICATION SYSTEM

(71) Applicant: Kimberly-Clark Worldwide, Inc., Neenah, WI (US)

(72) Inventors: Frederick J. Williams, Jr., Cumming, GA (US); Babak R. Ghazi, Smyrna, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 88 days.

(21) Appl. No.: 16/328,829

(22) PCT Filed: Aug. 30, 2016

(86) PCT No.: PCT/US2016/049478
§ 371 (c)(1),
(2) Date: Feb. 27, 2019

(87) PCT Pub. No.: WO2018/044276
PCT Pub. Date: Mar. 8, 2018

(65) Prior Publication Data
US 2019/0208967 A1 Jul. 11, 2019

(51) Int. Cl.
*A47K 10/36* (2006.01)
*A47K 10/32* (2006.01)

(52) U.S. Cl.
CPC .. *A47K 10/3662* (2013.01); *A47K 2010/3226* (2013.01)

(58) Field of Classification Search
CPC ..... A47K 10/3662; A47K 2010/3226; A47K 10/34; A47K 10/3625; A47K 2010/3675
See application file for complete search history.

(56) References Cited

U.S. PATENT DOCUMENTS

| | | | | |
|---|---|---|---|---|
| 4,422,402 | A * | 12/1983 | Ogihara | B65H 23/005 116/202 |
| 4,620,184 | A * | 10/1986 | Nedstedt | B65H 23/005 340/675 |
| 6,334,587 | B1 * | 1/2002 | Roder | B65H 18/28 242/160.4 |
| 7,040,566 | B1 * | 5/2006 | Rodrian | A47K 10/36 242/563 |
| 7,370,824 | B1 * | 5/2008 | Osborne | A47K 10/36 242/563 |
| 7,464,594 | B2 | 12/2008 | Cato et al. | |
| 7,793,882 | B2 | 9/2010 | Reinsel et al. | |
| 8,160,742 | B2 | 4/2012 | Goerg et al. | |
| 8,544,785 | B2 | 10/2013 | Pelland et al. | |
| 9,066,638 | B2 * | 6/2015 | Lowery | A47K 10/36 |
| 2001/0017309 | A1 * | 8/2001 | Formon | A47K 10/36 225/1 |
| 2005/0011987 | A1 * | 1/2005 | Lemaire | A47K 10/3662 242/563 |
| 2006/0006275 | A1 * | 1/2006 | Neveu | B65H 75/185 242/563 |
| 2012/0055272 | A1 | 3/2012 | Sanada et al. | |

FOREIGN PATENT DOCUMENTS

| | | | |
|---|---|---|---|
| CN | 101883514 | A | 11/2010 |
| CN | 102607494 | A | 7/2012 |
| CN | 103784072 | A | 5/2014 |
| CN | 103997939 | A | 8/2014 |

* cited by examiner

*Primary Examiner* — William A. Rivera

(57) ABSTRACT

Methods, systems and apparatus for determining or identifying the type of product in a dispenser based at least in part on the length of rolled product dispensed and/or the radial measurement.

16 Claims, 3 Drawing Sheets

PRODUCT IDENTIFICATION SYSTEM

This disclosure generally relates to determining or identifying the type of product in a dispenser.

BACKGROUND

Systems dispensing consumable products are ubiquitous in many environments today. For example, hand towel and bath tissue dispensers are commonplace in many private, semi-private and public washrooms and break rooms. Consumable products often have different characteristics, for example, roll length and bulk or thickness. And dispensers are often designed to dispense properly based on these particular characteristics. If products are loaded into a dispenser not designed to dispense such products then dispensing malfunctions and/or suboptimal dispensing can occur.

SUMMARY

In general, the subject matter of this specification relates to determining a type of rolled product in a dispenser based on radial measurements of the roll, and/or the length or number of roll sheets dispensed. In general, one aspect of the subject matter described in this specification can be implemented in systems that include a dispenser having a body including a product holding area configured to hold a rolled product; a first sensor proximate the product holding area and configured to determine a length of the rolled product dispensed; a second sensor proximate the product holding area and configured to determine a radial measurement of the rolled product; and a processing device configured to communicate with the first and second sensors and to determine a type of the rolled product based on the length of rolled product dispensed and the radial measurement. Other embodiments of this aspect include corresponding systems, apparatus, and methods.

Yet another aspect of the subject matter described in this specification can be implemented in methods that include determining, within a time range, a length of the rolled product dispensed; determining, within the time range, a diameter of the rolled product; and determining the type of the rolled product based on the length and the diameter. Other embodiments of this aspect include corresponding systems, apparatus, and computer program products.

In some implementations, the methods, systems, apparatus, and computer program products described herein have one or a combination of the following features. The rolled product can be a bath tissue roll or a paper towel roll. The dispenser can include a first sensor that is a rotary encoder or an optical linear sensor, a dispenser counter configured to count a number of dispenses, and a second sensor that is a potentiometer. The type of the rolled product can be used to identify a manufacturer of the rolled product including identifying a product level code of the rolled product.

In some implementations the dispenser can include a motor configured to rotate the rolled product for dispensing, and the processing device can be configured to prevent actuation of the motor in response to determining that the type of the rolled product is not an authorized rolled product. The dispenser can also include a transceiver, and the processing device can be configured to cause the transceiver to send an alert message in response to determining that the type of the rolled product is not an authorized rolled product. The processing device can be configured to cause the transceiver to send a message identifying the type of the rolled product. The processing device can be configured to determine an amount of rolled product remaining based on one of the radial measurement and the length (or both) or based only one of the radial measurement and the length. The time range is defined from a first dispensing event to a next consecutive dispensing event.

Particular embodiments of the subject matter described in this specification can be implemented so as to realize one or more of the following advantages. For example, based on the sheet thickness and/or roll diameter or length, the manufacturer and/or specific type (e.g., product name or code) of the rolled product can be identified. If the rolled product is not determined to be an authorized product for the dispenser then further dispensing can be prohibited and/or reported, as using unauthorized product in a dispenser can result in poor dispensing performance and/or quality or operational issues. Remotely identifying the type of rolled product in a dispenser can also be used to track inventory across an installed dispenser base, without requiring reporting of such information by service attendants, giving the owner/operator information as to which products are being used, including for use when determining how much and which type of product to re-order.

The details of one or more implementations of the subject matter described in this specification are set forth in the accompanying drawings and the description below. Other features, aspects, and advantages of the subject matter will become apparent from the description, the drawings, and the claims.

DESCRIPTION OF DRAWINGS

Like reference symbols in the various drawings indicate like elements.

DETAILED DESCRIPTION

The present disclosure generally relates to determining or identifying the type of product in a dispenser based on, for example, the diameter (e.g., radial measurement) and/or total length of the roll and/or the sheet thickness of the roll.

Rolled products, including, for example, bath tissue and hand towel rolls, have specific characteristics such as overall roll length, e.g., cumulative length of all of the roll's sheets (e.g., if the roll is comprised of sheets separated by perforations), roll diameter, and roll sheet thickness. These characteristics often differ based on the manufacturing process and materials used to create the rolls (e.g., fiber types, sizes, and/or fiber mixtures). In some instances these characteristics can be used to identify the product as to its type (e.g., a specific brand or sub-brand) or manufacturer, or exclude it as being a specific type or from a specific manufacturer.

To that end, the dispenser includes first and second sensors. The first sensor determines the length of the rolled product dispensed. For example, the first sensor may optically or electro-mechanically determine the length of the roll dispensed (e.g., at a point in time or over a time period). With that information the cumulative length of the roll dispensed since new or installed (or since some other point in time or condition) can be determined. The second sensor can determine a radial measurement of the roll (e.g., the roll radius or diameter or changes in the roll radius or diameter over time). Based on the length and/or radial measurements, the dispenser can determine, for example, the thickness of the sheets on the roll.

As thickness (or roll diameter or length or some combination thereof) can be a characteristic to distinguish between different types of rolls (e.g., one from Manufacturer A and one from Manufacturer B), the dispenser can determine whether that characteristic matches the same characteristic from an authorized roll(s). If the roll is determined to be unauthorized, the dispenser can, for example, prevent further dispensing or send an alert message to an operator or service attendant. In some implementations, the dispenser may store or have access to signatures or characteristics from many rolls that it can use to match and identify the installed roll (and thus determine if it is authorized or unauthorized). The dispenser is described in more detail below with reference to FIGS. 1A, 1B, and 1C.

Figure 1A:
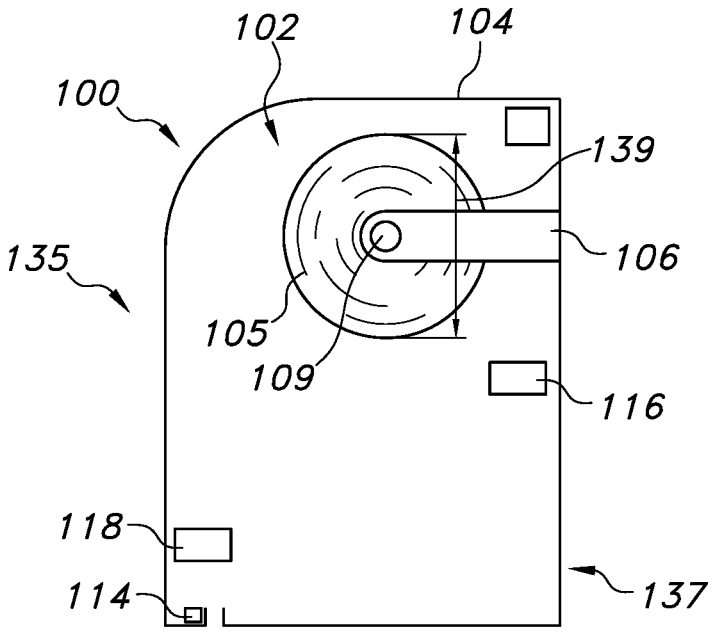
FIG. 1A is a representation of an example product dispenser.

FIG. 1A is a representation of an example product dispenser 100. In some implementations, the dispenser 100 includes a processing device 118 or, if the processing device 118 is remote to the dispenser 100, can wirelessly communicate with the processing device 118. The dispenser 100 can be located in, for example, a private, semi-private or public washroom or break room or kitchen or another space in which a dispenser 100 and can be located such as at or in clean rooms or other work stations. The dispenser 100 can be, for example, a hand towel dispenser 100, or a bath tissue dispenser 100, or the like.

Figure 1B:
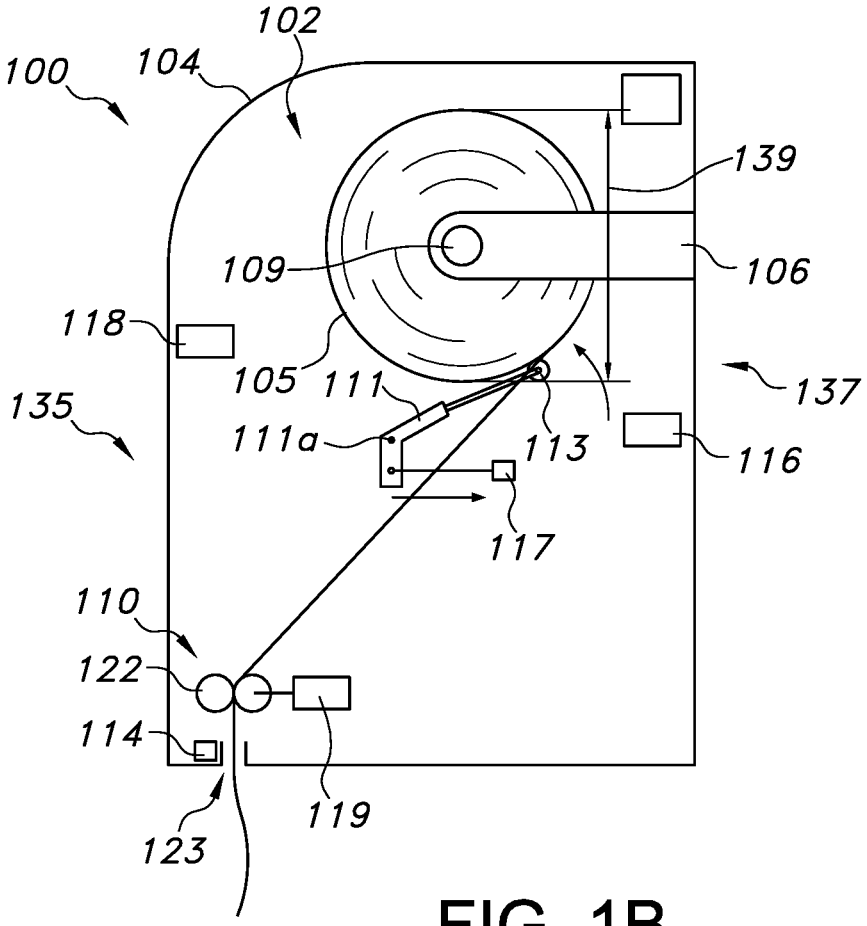
FIG. 1B is a representation of an example product dispenser with a first amount of product.
Figure 1C:
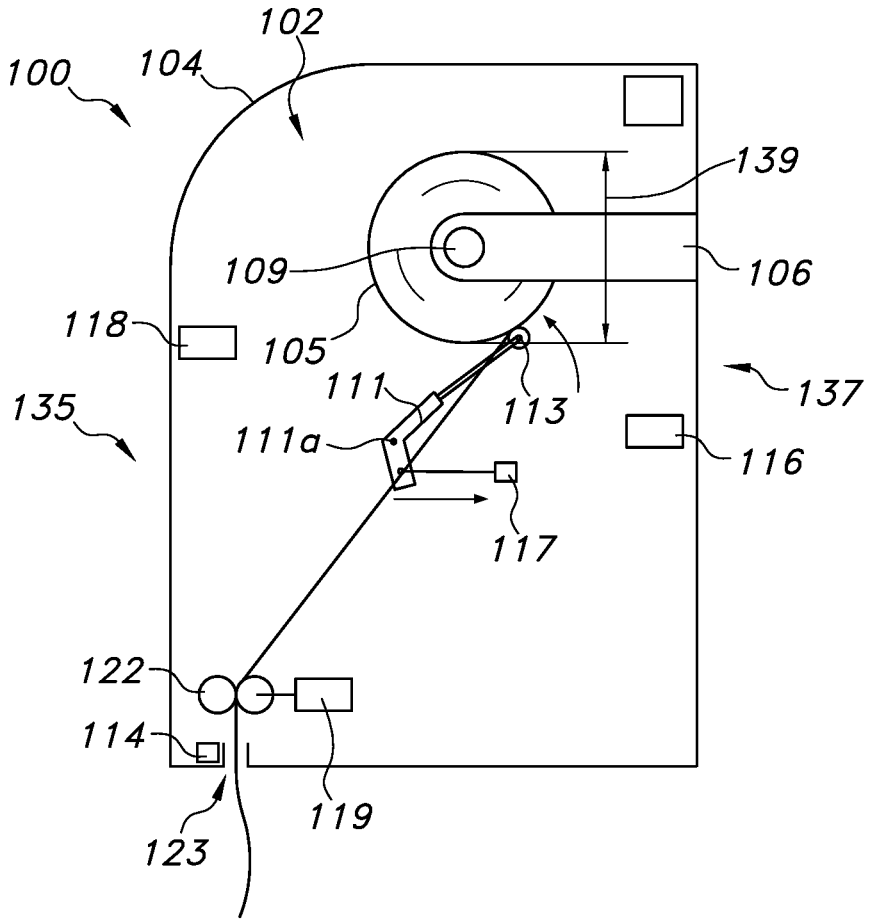
FIG. 1C is a representation of the example product dispenser with a second amount of product.

FIG. 1B is a representation of an example product dispenser 100 with a first a first amount of product and FIG. 1C is a representation of the example product dispenser 100 with a second amount of product. In some implementations, the dispenser 100 includes a body 104, e.g., a composite or metal housing, including a product holding area 102. In some implementations, the product holding area 102 is a space or cavity within the body 104 in which rolled product 105 can be positioned for dispensing, and can be accessed by rotating a front portion 135 of the body 104 away from a back portion 137 (e.g., the wall mounted portion) by a hinge or the like. The product holding area 102 can be enclosed within the body 104 or partially exposed (e.g., for access without opening the body 104). The product holding area 102 can include a roll holder 106 to hold rolled product 105, e.g., bath tissue or paper (hand) towels. In these representations, a portion of the body 104 (e.g., a side cover portion) is not shown to illustrate the interior of the dispenser 100.

The dispenser 100 also includes a dispensing mechanism 110. The dispensing mechanism 110 operates to dispense a portion of the roll 105 (e.g., dispense a length of roll 105 for use to dry hands). In some implementations, the dispensing mechanism 110 is an electromechanical feed mechanism that includes or operates in conjunction with a motor 119 that, in response to a stimulus such as a user waving a hand proximate the dispenser 100, feeds a length of the roll 105 through an opening 123 in the body 104 to present to the user. For example, the dispensing mechanism 110 can include a series of rollers 122 through which a portion of the roll 105 is feed such that when the dispensing mechanism 110 actuates it pulls and unwinds the roll 105 (or causes the roll 105 to be pulled and unwound) to feed a portion of the roll 105 to the user. In some implementations, the motor 119 can be integral to the roll holder 106 and causes a spindle 109 of the roll holder 106 (e.g., on which the rolled product 105 is mounted) to turn thereby causing the roll 105 to unwind and be dispensed.

The dispenser 100 includes a first sensor 113 proximate or in the product holding area 102. The first sensor 113 determines the length of the rolled product 105 dispensed. For example, the first sensor 113 can determine the length of product 105 dispensed on a per-dispense basis or keep a running total of product dispensed, e.g., since the roll 105 was installed or since another trigger event such as opening the front portion 135 of the body. In some implementations, the first sensor 113 includes a rotary encoder 113 mounted on, for example, an arm 111 that engages a periphery of the roll 105 such that when the roll 105 spins the rotary encoder 113 rolls along the outer surface (e.g., circumference) of the of the roll 105.

In some implementations, the rotary encoder 113 is an electro-mechanical device that converts the angular position or distance or rotation of a rotating device (e.g., a rolled product 105 or spindle 109) to an analog or digital signal representative of the number of revolutions or partial revolutions of the rotating device. For example, if the rotary encoder 113 is engaged to the periphery of the roll 105 (as shown in FIGS. 1B and 1C) the rotary encoder 113 turns as the roll 105 rotates. Each full rotation of the rotary encoder 113 corresponds to some distance of sheet length on the roll 105, which can be predefined by an administrator. For example, one rotation of the rotary encoder 113 against the periphery of the roll 105 may correspond to 2.5 inches of sheet length unwound (e.g., for dispensing to a user). Thus if the rotary encoder 113 senses that it has rotated twice it can be determined (e.g., by the processing device 118 as described below) that five inches of sheet length has been dispensed.

In some implementations, the first sensor 113 senses the angular distance or movement of a spindle 109 or other device (e.g., inserted into the core of and) carrying the roll 105. For example, the angular distance can be measured by a series of magnetic pickups mounted on the spindle 109 or otherwise positioned and coordinated to rotate with the spindle 109. The first sensor 113 can sense each pickup as it passes the first sensor 113 (e.g., which is in a fixed and constant position relative to the rotating spindle 109). The sensing of each pickup corresponds to a preprogrammed angular distance. For example, if each pickup is positioned twelve degrees apart then if the first sensor 113 senses four pickups pass during a dispensing operation then the spindle 109 (and roll 105) have rotated forty eight degrees. Such information, for example, in combination with the diameter or radius of the roll 105 can be used to determine the length of the roll 105 dispensed. Further, the magnetic pickups could specifically vary in strength (e.g., Gauss) such that the first sensor 113 can determine the position of the spindle 109 based on the strength of the last sensed pickup.

Alternatively, the first sensor 113 can be an optical sensor 113. For example, the optical sensor 113 can be a camera 113 that views the spindle 109 and/or roll 105 and counts rotations or partial rotations based on one or more visible characteristics of the spindle 109 and/or roll 105. In some implementations, these visible characteristics can be features of the spindle 109 (e.g., a line or tick mark on the spindle 109) and/or roll 105 (e.g., embossed or printed pattern on the roll sheets), and the processing device 118 can use various techniques such as classification, clustering and/or regression algorithms to process the images from the first sensor 113 and determine the number of rotations or partial rotations and therefrom the length of roll sheet unwound/dispensed.

The dispenser 100 includes a second sensor 117 to determine a radial measurement 139 of the rolled product 105.

The radial measurement 139 describes the diameter of the roll 105, which can readily be converted into the roll's radius (i.e., radius=diameter/2).

In some implementations, the second sensor 117 is coupled to the arm 111, which pivots around point 111*a* on one end and rests on the periphery of the first roll 105 at the other end (e.g., through the first sensor 113). As the roll 105 is used, reducing its diameter, the arm 111 pivots resulting in a change in its angular position. The second sensor 117 measures this change, which corresponds to predefined changes in the roll's diameter. For example, if the arm 111 pivots three degrees this may correspond to a two centimeter change in the roll's diameter. As described, the mapping between the arm's angular position (or change thereof) and the corresponding change in the roll's diameter can be predefined by an administrator (e.g., a manufacturer of the dispenser 100) and programmed into the processing device 118.

In some implementations, the second sensor 117 is a potentiometer mounted to or operational to read the arm 111 pivot (e.g., at point 111*a*) and generate, for example, a resistance or voltage that corresponds and represents the extent that the arm 111 rotated or pivoted. In some implementations, the second sensor 117 is or uses an infrared or some detection system to measure, for example, a change in the diameter of the roll 105, e.g., based on the distance between system sensors and the periphery of the roll 105, to determine its diameter.

In some implementations, the dispenser 100 includes a dispenser counter 114 that counts a number of dispenses of the roll 105. For example, the dispenser counter 114 counts (e.g., increments from zero) each dispense from the dispenser 100. In some implementations, the dispenser counter 114 is reset (e.g., to zero) each time the roll 105 is replaced/removed/inserted and/or when the body 104 is removed or opened/closed for the same, or manually reset by an operator locally or remotely. For example, the dispenser counter 114 can include a proximity sensor (e.g., an infrared sensor) positioned near the opening 123 through which the product 105 is dispensed to detect the presence and absence of dispensed product 105 such that a cycle of a product presence (e.g., a dispense through the opening) followed by a product absence (e.g., a removal of the product from the opening by a user) proximate the opening 123 is one count.

In some implementations, the dispenser 100 permits a user to select how much product is dispensed by an actuation/dispense cycle. In this case, the processing device 118 can track and store the number of dispenses, which would include the number of dispenses at each length. For example, if there are two dispensing lengths then the report would indicate that 300 dispenses of 8 inches occurred and 130 dispenses of 6 inches occurred or 430 dispenses or 8 inches occurred, and also indicate the current dispense length setting (e.g., 6 or 8 inches). With the programmatically set length of each roll, the processing device 118 can determine how much of the roll 105 has been used and how much remains. For example, if the roll 105 has 1000 inches of product and there were 70 reported dispenses of 8 inches then the data processing system 118 determines that 560 inches of product have been dispensed and 440 inches remain.

The dispenser 100, in some implementations, includes a data communication device 116 (e.g., transmitter or transceiver) that operates to communicate with other devices (e.g., through wired or wireless channels or some combination thereof). For example, the data communication device 116 transmits the number of dispenses determined from the dispenser counter 114, the roll diameter and/or the sheet length dispensed to other devices. The data communication device 116 can use any number of communication protocols including, for example, WIFI, BLUETOOTH and TCP/IP to name a few.

As described, the dispenser 100 can include a processing device 118. The processing device 118 communicates with the first sensor 113 and second sensor 117 and can determine a type of the rolled product 105 in the dispenser 100 based on the length of rolled product 105 dispensed/unwound and/or the radial measurement of the roll 105. The processing device 118 can be part of or separate (e.g., remote) from the dispenser 100. In implementations where the processing device 118 is remote from the dispenser 100, the processing device 118 and dispenser 100 can communicate across wireless or wired channels, or some combination thereof. For example, in such implementations, the processing device 118 includes a transceiver and microprocessor to facilitate such communications. In some implementations, the processing device 118 is connected to a WAN or LAN to communicate to and with other devices such as mobile devices and/or servers.

The processing device 118 receives data describing the length of roll 105 dispensed from the first sensor 111 and the radial measurement 139 from the second sensor 117. The sensor data can be provided by the sensors 113, 117 to the processing device 118 in response to an event detected by the sensors 113, 117 and/or when polled by the processing device 118. The data processing device 118 uses this information to determine the type of rolled product 105 in the dispenser 100. The type of rolled product describes the manufacturer, seller and/or brand of the product and, in some instances, uniquely or quasi-uniquely identifies the product at a Stock Keeping Unit (e.g., a specific product code) type level. In some implementations, the processing device 118 is programmed with features or characteristics of numerous rolled products such as roll diameter, roll length, sheet length, basis weight, and/or sheet thickness, to name a few. For example, the processing device 118 may store data from Table 1.

TABLE 1

| Product Type | Sheet Thickness | Full Roll Length | Full Roll Diameter | Roll Diameter/ 500 Inches Dispensed |
|---|---|---|---|---|
| Manufacturer A/Product 1 | .01 inches | 950 inches | 8 inches | 4.5 inches |
| Manufacturer B/Product 2 | .012 inches | 1125 inches | 8.5 inches | 5.2 inches |
| Manufacturer C/Product 3 | .03 inches | 1100 inches | 8.2 inches | 5 inches |

In some implementations, the processing device 118 can identify the type of product 105 based on data from the first sensor 113, the second sensor 117 and/or Table 1. Consider a new roll 105 is placed in the dispenser 100, as determined by a sensor triggering when the dispenser 100 is opened or closed for a refill, e.g., a contact sensor, or as set by a maintenance attendant or system administrator. The processing device 118 can determine the length of product dispensed, based on data from the first sensor 113, until the roll 105 is depleted, e.g., as determined from data from the dispenser counter 114 and/or first sensor 113. Based on the determined length and Table 1, the processing device 118 can determine the corresponding matching product type. For example, if the length of the roll 105 was determined to be 1125 inches then the processing device 118 determines that the roll 105 was Product 2 from Manufacturer B. In some implementations, the product types are associated with ranges or tolerances to allow for minor errors or deviations, either through manufacturing of the rolls or sensing by the dispenser 100. For example, the length range for a full roll of Manufacturer A/Product 1 could be 945-955 inches.

Likewise, based on the data from the second sensor 117, the processing device 118 can determine the type of roll 105. For example, for a new roll 105, the processing device 118 determines from data from the second sensor 117 that the diameter is 8.15 inches. Based on a diameter range for Manufacturer C/Product 3 of 8.1 to 8.3 inches, the processing device determines that the roll 105 is Product 3 from Manufacturer C.

The processing device 118 can additionally or alternatively determine the type of roll 105 based on the sheet thickness of the roll 105. For example, the processing device 118 can determine from the first sensor 113 when the spindle 109 has rotated 360 degrees from a starting point (e.g., by counting the number of magnetic pickups passed on the spindle 109 as it rotates). The change in roll diameter between the starting point and the ending point (one full turn later), as determined by the processing device 118 by use of data from the second sensor 117, represents the roll thickness. Given the variability of thickness across a sheet of roll 105 this calculation may be performed multiple times and the thicknesses averaged to reach a final thickness value. For example, if the diameter of the roll 105 is 6.004 inches at a starting point (e.g., a given point in time and spindle 109 position) and after one full turn of the spindle 109, and thus roll 105, the diameter is 5.094 (which equals a 0.01 change in diameter) then, based on Table 1, the processing device 118 determines that the roll 105 is Product 1 from Manufacturer A.

In at least these ways the processing device 118 can determine the type of rolled product 105 in the dispenser 100. In some implementations, the processing device 118 stores data describing authorized types of rolls. For example, for a dispenser from Manufacturer A, only Product 1 may be authorized, while Product 2 and Product 3 are not authorized. Based on this data and the determination of the type of rolled product 105 the processing device 118 can determine whether the roll 105 installed in the dispenser 100 is authorized or not. The authorization list can be changed or otherwise updated programmatically by an administrator through use of the data communication device 116.

In some implementations, the processing device 118 can determine the amount of rolled product 105 remaining and/or used. As described above, the processing device 118 can determine the type of rolled product 105, e.g., from the roll diameter or thickness, which indicates the initial length and diameter of the roll (e.g., from Table 1). Based on the information identifying the initial length or diameter and knowing one or more of the number of sheets dispensed (and a per sheet dispense length), sheet thickness current diameter, and cumulative length dispensed, the processing device 118 can determine the amount of product 105 remaining or determine if a product remaining threshold has been met (e.g., 1 inch diameter, 100 feet or 60 sheets remaining threshold). For example, if the product has been identified as Product 1 from Manufacturer A and the current diameter is determined to be three inches, then the processing device can use, for example, a preprogrammed look-up table (e.g., locally stored or accessible through use of the data communication device 116), storing diameter to amount of product remaining values, to determine how much rolled product 105 is remains. Thus, for Product 1 from Manufacturer A, if the look up table indicates that a three inch diameter corresponds to thirty five percent product remaining then the processing device 118 can read that value from the table and process the information accordingly, e.g., send out a message with the percent remaining value.

Likewise the processing device 118 can use information from the dispenser counter 114, indicating the number of dispensed sheets, and the look-up table (e.g., in a form similar to Table 1), storing data describing the number of sheets per roll at a given sheet length, to determine the amount of product remaining. For example, if Product 1 from Manufacturer A has 400 sheets and the dispenser counter 114 indicates that 250 sheets have been dispensed then the processing device 118 determines that 150 sheets remain.

The processing device 118 can also use information from both the first and second sensors 113, 117 to determine the amount of product remaining, e.g., as an internal check and balance of such determination. For example, at a given time, the processing device 118 can poll or query the first sensor 113 (or take the most recent reading from the first sensor 113) and do the same with the second sensor 117 to determine the current value for sheet length dispensed and diameter, respectively. The processing device 118 can use these values in combination with data from a look-up table indicating the relationships between sheet length dispensed and the amount of product remaining and between diameter and the amount of product remaining to determine the amount of product remaining from each sensed value (i.e., the current length dispensed and current diameter).

If the sheet length dispensed and diameter values each indicate that thirty percent of the roll 105 (or within some tolerance range around thirty percent) remains then the processing device 118 determines that there is a high confidence that the product remaining determination is accurate and can report that value. However, if the calculation of the amount of product remaining from the length dispensed value and the calculation of the amount of product remaining from the diameter value do not fall within the tolerance range then the processing device 118 determines that there may be an anomaly and cause the data communication device 116 to send an alert message.

As described above, the dispenser 100 can include a motor 119. The processing device 118 can be coupled to the motor 119 (e.g., through a wired or bus type connection or through another device such as a motor controller) and control the operation of the motor 119. In some implementations, in response to determining that the roll 105 is not an authorized product, the processing device 118 instructs the motor 109 to not actuate or prevents the motor 109 from actuating and, thus, from dispensing any additional rolled product 105. As many dispensers are designed to dispense certain products, operating those dispensers with other products (e.g., from different manufacturers whose products may vary in one or more of the roll characteristics described above) can cause dispenser malfunctions or cause suboptimal dispensing performance.

In some implementations, the first sensor 113 can be used to count or sense the number of dispenses based on a number of the motor actuations, which the processing device 118 determines based on rotations of the roll 105. For example, each time the first sensor 113 senses the roll 105 rotating (beyond some low threshold value that will exclude minor shifts or vibrations in the dispenser 100) the processing device 118 determines that a motor actuation occurred and hence a dispensing event occurred, which causes the processing device 118 to increment the dispensing count. As described above the dispensing count can be reset, for example, during a refill event in which a new roll 105 is placed in the dispenser 100.

In some implementations, the processing device 118 causes the data communication device 116 to send an alert message (e.g., to a system administrator) in response to determining that the rolled product 105 is not an authorized product. Additionally or alternatively, the processing device 118 can cause the data communication device 116 to send a message identifying the type of the rolled product 105 in use.

Figure 2:
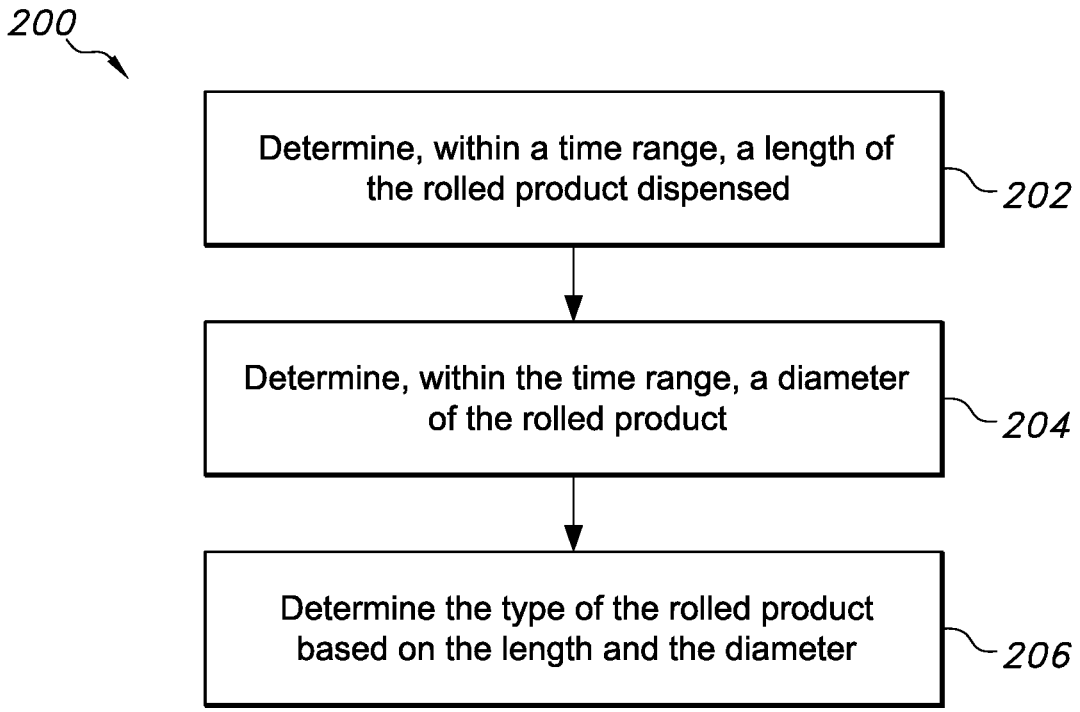
FIG. 2 is a flow chart of an example process for determining a type of product in a dispenser.

FIG. 2 is a flow chart of an example process for determining a type of product in a dispenser. The dispenser 100 can, for example, perform the steps described with reference to FIG. 2.

Within a time range, a length of the rolled product dispensed is determined (202). For example, the processing device 118 uses data from the first sensor 113 to determine the length of product 105 dispensed at a given time (or between given dispensing events).

Within the time range, a diameter of the rolled product is determined (204). For example, the processing device 118 uses data from the second sensor 117 to determine the diameter of product 105 dispensed.

The type of the rolled product based on the length and the diameter is determined (206). For example, the processing device 118 determines the type of rolled product 105 in the dispenser 100, as described above. The type of rolled product can refer to authorized or unauthorized product (e.g., as set by an administrator or owner or manufacturer of the dispenser 100. The type of rolled product can also or alternatively refer to the identity of the manufacturer or distributor of the rolled product and/or the particular brand and product name the rolled product 105 is sold under.

Implementations of the subject matter and the operations described in this specification can be implemented, at least in part, in digital electronic circuitry, or in computer software, firmware, or hardware, including the structures disclosed in this specification and their structural equivalents, or in combinations of one or more of them. Implementations of the subject matter described in this specification can be implemented, at least in part, as one or more computer programs, i.e., one or more modules of computer program instructions, encoded on computer storage medium for execution by, or to control the operation of, data processing apparatus. Alternatively or in addition, the program instructions can be encoded on an artificially-generated propagated signal, e.g., a machine-generated electrical, optical, or electromagnetic signal, that is generated to encode information for transmission to suitable receiver apparatus for execution by a data processing apparatus.

A computer storage medium can be, or be included in, a computer-readable storage device, a computer-readable storage substrate, a random or serial access memory array or device, or a combination of one or more of them. Moreover, while a computer storage medium is not a propagated signal, a computer storage medium can be a source or destination of computer program instructions encoded in an artificially-generated propagated signal. The computer storage medium can also be, or be included in, one or more separate physical components or media (e.g., multiple CDs, disks, or other storage devices).

The operations described in this specification can be implemented as operations performed by a data processing apparatus or system on data stored on one or more computer-readable storage devices or received from other sources.

The term processing device or data processing system encompasses all kinds of apparatus, devices, and machines for processing data, including by way of example a programmable processor, a computer, a system on a chip, or multiple ones, or combinations, of the foregoing The apparatus can include special purpose logic circuitry, e.g., an FPGA (field programmable gate array) or an ASIC (application-specific integrated circuit). The apparatus can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The apparatus and execution environment can realize various different computing model infrastructures, such as web services, distributed computing and grid computing infrastructures.

A computer program (also known as a program, software, software application, script, or code) can be written in any form of programming language, including compiled or interpreted languages, declarative or procedural languages, and it can be deployed in any form, including as a stand-alone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform actions by operating on input data and generating output. The processes and logic flows can also be performed by, and apparatus can also be implemented as, special purpose logic circuitry, e.g., an FPGA (field programmable gate array) or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are a processor for performing actions in accordance with instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a personal digital assistant (PDA), a mobile audio or video player, a game console, a Global Positioning System (GPS) receiver, or a portable storage device (e.g., a universal serial bus (USB) flash drive), to name just a few. Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

Implementations of the subject matter described in this specification can be implemented in a computing system that includes a back-end component, e.g., as a data server, or that includes a middleware component, e.g., an application server, or that includes a front-end component, e.g., a client computer having a graphical user interface or a Web browser through which a user can interact with an implementation of the subject matter described in this specification, or any combination of one or more such back-end, middleware, or front-end components. The components of the system can be interconnected by any form or medium of digital data communication, e.g., a communication network. Examples of communication networks include a local area network ("LAN") and a wide area network ("WAN"), an inter-network (e.g., the Internet), and peer-to-peer networks (e.g., ad hoc peer-to-peer networks).

The computing system can include clients and servers. A client and server are generally remote from each other and typically interact through a communication network. The relationship of client and server arises by virtue of computer programs running on the respective computers and having a client-server relationship to each other. In some embodiments, a server transmits data (e.g., an HTML page) to a user computer (e.g., for purposes of displaying data to and receiving user input from a user interacting with the user computer). Data generated at the user computer (e.g., a result of the user interaction) can be received from the user computer at the server.

While this specification contains many specific implementation details, these should not be construed as limitations on the scope of any inventions or of what may be claimed, but rather as descriptions of features specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

This written description does not limit the invention to the precise terms set forth. Thus, while the invention has been described in detail with reference to the examples set forth above, those of ordinary skill in the art may effect alterations, modifications and variations to the examples without departing from the scope of the invention.

What is claimed is:

1. A dispenser comprising:

a body including a product holding area configured to hold a rolled product;

a first sensor proximate the product holding area and configured to determine a length of the rolled product dispensed;

a second sensor proximate the product holding area and configured to determine a radial measurement of the rolled product, wherein the second sensor is a single sensor device; and a processing device configured to communicate with the first and second sensors and to:

(i) determine, multiple times for the rolled product, thicknesses of sheets of the rolled product;

(ii) average the thicknesses; and (iii) determine a type of the rolled product based on the length of rolled product dispensed and the radial measurement including the average thickness.

2. The dispenser of claim 1, wherein the determinations of the length of rolled product dispensed and the radial measurement are within a specified time range of one another.

3. The dispenser of claim 1, wherein the rolled product is bath tissue roll.

4. The dispenser of claim 1, wherein the rolled product is a paper towel roll.

5. The dispenser of claim 1, wherein the first sensor is a rotary encoder.

6. The dispenser of claim 1, wherein the first sensor is an optical sensor.

7. The dispenser of claim 1, wherein the second sensor is a potentiometer.

8. The dispenser of claim 1, wherein the type of the rolled product identifies a manufacturer of the rolled product.

9. The dispenser of claim 8, wherein the type of the rolled product identifies a product level code of the rolled product.

10. The dispenser of claim 1 comprising a motor configured to rotate the rolled product for dispensing, and wherein the processing device is configured to prevent actuation of the motor in response to determining that the type of the rolled product is not an authorized rolled product.

11. The dispenser of claim 1 comprising a transceiver, and wherein the processing device is configured to cause the transceiver to send an alert message in response to determining that the type of the rolled product is not an authorized rolled product.

12. The dispenser of claim 1, wherein the processing device is configured to determine an amount of rolled product remaining based on one of the radial measurement and the length.

13. The dispenser of claim 12, wherein the processing device is configured to determine the amount of rolled product remaining based only on data from one of the radial measurement and the length of rolled product dispensed.

14. The dispenser of claim 1 comprising a transceiver, and wherein the processing device is configured to cause the transceiver to send a message identifying the type of the rolled product.

15. The dispenser of claim 1, comprising a dispenser counter configured to count a number of dispenses.

16. The dispenser of claim 1 comprising a motor configured to rotate the rolled product for dispensing, and wherein the first sensor is configured to count the number of dispenses based on a number of the motor actuations.

* * * * *